US005490350A

United States Patent [19]

Eisenschenk et al.

[11] Patent Number: 5,490,350

[45] Date of Patent: Feb. 13, 1996

[54] TREE STAND

[75] Inventors: Johann Eisenschenk, Stamsried; Klaus Krinner, Strasskirchen, both of Germany

[73] Assignee: Krinner GmbH, Strasskirchen, Germany

[21] Appl. No.: 137,148

[22] PCT Filed: Apr. 15, 1992

[86] PCT No.: PCT/DE92/00319

§ 371 Date: Feb. 10, 1994

§ 102(e) Date: Feb. 10, 1994

[87] PCT Pub. No.: WO92/18038

PCT Pub. Date: Oct. 29, 1992

[30] Foreign Application Priority Data

Apr. 15, 1991 [DE] Germany ..... 9104560 U

[51] Int. Cl.[6] ..... A47G 7/02

[52] U.S. Cl. ..... 47/40.5; 248/523

[58] Field of Search ..... 47/40.5; 248/523, 248/231.2, 231.6

[56] References Cited

U.S. PATENT DOCUMENTS

| | | | |
|---|---|---|---|
| 288,058 | 11/1883 | Hollister | 248/523 |
| 774,497 | 11/1904 | Rompel | 248/523 |
| 909,634 | 1/1909 | Mitchell . | |
| 958,644 | 5/1910 | Huff | 248/523 |
| 1,540,856 | 6/1925 | Munro | 248/523 |
| 1,568,758 | 1/1926 | Malcolm | 248/523 |
| 2,628,798 | 2/1953 | Kass et al. . | |
| 2,630,287 | 3/1953 | Trogdon | 248/523 |
| 2,913,202 | 11/1959 | Meldrum | 47/40.5 |
| 3,784,136 | 1/1974 | Lopez . | |
| 4,310,989 | 1/1982 | Shannon, Jr. . | |
| 4,326,703 | 4/1982 | Marley | 248/523 |
| 4,712,328 | 12/1987 | Gies | 47/40.5 |
| 4,825,586 | 5/1989 | Coppedge | 47/40.5 |
| 4,856,743 | 8/1989 | Sweeney | 248/523 |
| 4,936,538 | 6/1990 | Royce | 47/40.5 |
| 5,137,246 | 8/1992 | Idso | 248/523 |
| 5,291,709 | 3/1994 | Vranjesevic | 248/523 |

FOREIGN PATENT DOCUMENTS

| | | | |
|---|---|---|---|
| 469954 | 12/1950 | Canada | 47/40.5 |
| 1050517 | 3/1979 | Canada | 47/40.5 |

*Primary Examiner*—Ramon S. Britts
*Assistant Examiner*—Joanne C. Downs
*Attorney, Agent, or Firm*—Sterne, Kessler, Goldstein & Fox

[57] ABSTRACT

A Christmas-tree stand (2) essentially consists of a housing (6) in which two clamping bars (18, 20) are rotatably supported so as to allow a swivelling movement around two support pins (22, 24). The activation of the clamping straps (18, 20) takes place via a central clamping device which essentially consists of a threaded rod (26) with two inversely threaded sections (32, 34) constructed thereon. When rotating the threaded rod (26), the free ends of the clamping bars (18, 20) are moved along by the nuts (30, 30') running along with the threaded sections (32, 34), so that a Christmas-tree trunk can be fixed or fastened between the clamping bars (18, 20).

11 Claims, 2 Drawing Sheets

Fig. 2
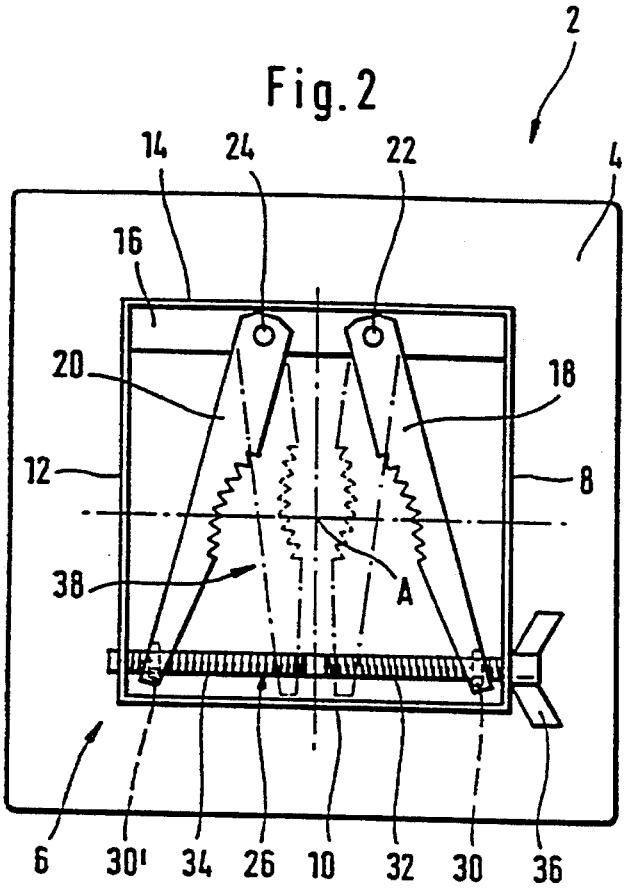
Fig. 5
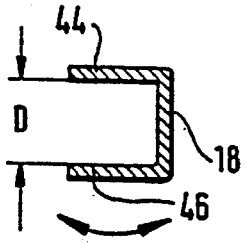
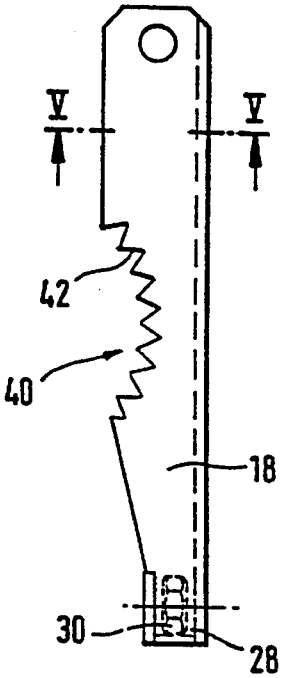
Fig. 4
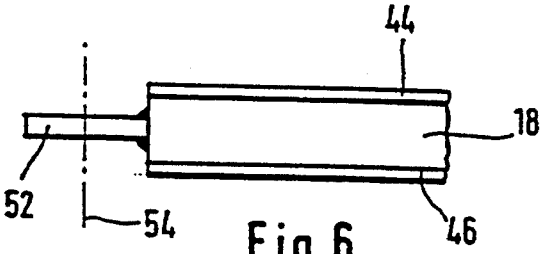
Fig. 6
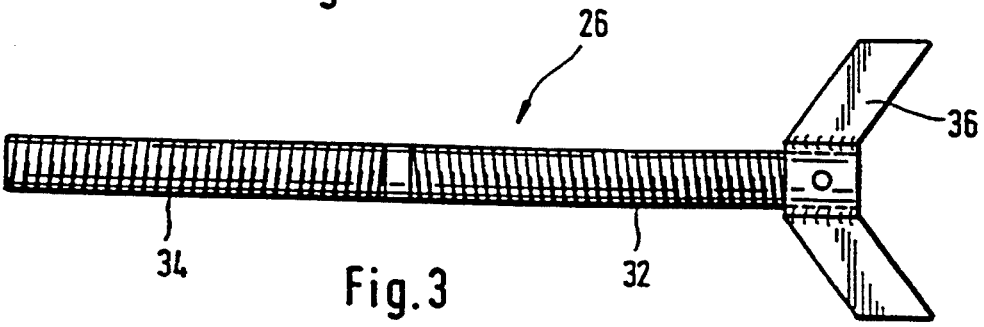
Fig. 3

TREE STAND

The invention relates to a Christmas-tree stand as described in the preamble of claim 1.

With respect to Christmas-tree stands, it is generally a problem to securely fasten the Christmas-tree to be erected in such a way that the fastened Christmas-tree is essentially vertical, with the clamping procedure being as simple as possible and requiring little effort. A plurality of Christmas-tree stands are known which deal with the problem of making the fastening of a Christmas-tree in an essentially vertical position as efficient and simple as possible.

Christmas-tree stands are known in which the trunk end of the Christmas tree to be fixed and/or fastened can be fixed by a plurality of clamp screws radially arranged in the peripheral direction of the trunk. For this, the trunk end of the Christmas tree to be fastened is inserted in a sheath or pipe which is horizontally penetrated by clamp screws. By individually tightening the screws, the free ends of the screws may in part also penetrate into the material of the Christmas-tree, the Christmas-tree then being fixed in the sheath. The sheath is connected to the base or stand portion to ensure the necessary stability. The disadvantage with these known Christmas-tree stands, which are known in a plurality of variations and modifications, is the fact that a plurality of clamp screws, as a rule three or four of such clamp screws, has to be tightened individually in order to ensure a fastening as exact, i.e. as vertical as possible of the Christmas-tree trunk. Especially in the case of relatively large Christmas-tree and, thus, with large branches at the base, the individual tightening and, if necessary, again loosening of the clamp screws can only be accomplished in an awkward and complicated way.

A further category of Christmas-tree stands uses movable clamping arms or clamping bars which are forcibly engaged with a fixed support and thus fasten the trunk of the Christmas-tree to be fixed between each other. Examples of such Christmas-tree stands are known are publications DE-A 35 24 588 and DE-A 37 02 773. In these Christmas-tree stands, the trunk or the free trunk end to be fixed or fastened is fastened in the manner of a vise between a fixed or stationary support and a clamping arm or bar movable in relation thereto. The movement of the clamping arm and the application of the necessary clamping and retaining forces is caused by threaded spindles which have to be manipulated by hand. The plane of attack, i.e. the point on the free end of the Christmas-tree to be clamped between the fixed support and the movable clamping arm, is at a certain height and the lowest free end of the Christmas-tree trunk is fixed by a centering spike, which is vertically pointing and fixed to the Christmas-tree stand, so that, after fastening, the Christmas-tree trunk is fixed in the way of a three-point-support.

The disadvantage of Christmas-tree stands using a fixed support and a clamping arm movable in relation thereto, as described in DE-A 35 24 588 and DE-A 37 02 773, is the fact that tree trunks whose clamping region is not round or which considerably deviate from the round contour due to stumps of branches or the like can only with difficulty be fastened in a vertical position, if the lowest free trunk end has already been fixed by the centering spike. During the clamping of a tree trunk with such a non-circular or irregular contour by the movable clamping arm, which presses the trunk against the fixed support, said trunk with a non-circular or irregular contour can be pressed out of its vertical position, i.e. it may be fastened slantingly or askew during the clamping procedure.

In order to better meet the problem of tree trunks with non-circular or irregular contours, a Christmas-tree stand is known from DE-C 517 609 in which the Christmas-tree trunk can be fastened between clamping bars which are movable in relation to each other. For this, two separate clamping units are provided in the stand of DE-C 517 609, which are arranged horizontally one over the other at a distance from each other in a common housing. Each of the clamping units consists of two threaded rods parallel to each other and horizontally arranged, with two clamping bars being movably guided on the threaded rods. By means of thumb nuts which are in threaded engagement with the threaded rods, the clamping bars can be moved towards each other in such a way that the inner width of a receiving opening formed between the clamping bars can be adjusted, i.e. reduced. During the reduction of the receiving opening, the clamping bars engage the Christmas-tree trunk and by individually tightening the thumb nuts, the clamping bars can also be fitted to a trunk with a non-circular or irregular contour in such a way that the completely clamped Christmas-tree is essentially vertical. In order to produce the necessary retaining forces, two of the mentioned clamping units are provided, which are positioned above and at a distance from each other in the common housing, so that the Christmas-tree is forcibly engaged by the clamping forces as applied over a certain axial length and the tree is essentially secure against tilting.

Although Christmas-trees with a non-circular or irregular contour can be fastened or fixed essentially vertically according to DE-C 517 609, considerable disadvantages are inherent with this known Christmas-tree stand. Thus, with respect to the subject matter of DE-C 517 609, in the most unfavorable case, eight thumb nuts which are independent from each other have to be individually tightened or loosened in order to be able to optimally bring the altogether four clamping bars, running on the four threaded rods, into engagement with the Christmas-tree trunk. As already mentioned, the tightening of thumb nuts or the like is very awkward if large Christmas-trees with correspondingly large branches at their bases are concerned. The removal of a Christmas-tree from such a Christmas-tree stand also has its disadvantages in the fact that Christmas-trees which were fastened in a Christmas-tree stand for a long time are known to shed needles to a larger or smaller extent. Due to the continuous and extensive manipulations in the area of the known Christmas-tree stand according to DE-C 517 609 in the endeavour to loosen the thumb nuts positioned there, a Christmas-tree fastened in said known Christmas-tree stand will shed needles to a large extent due to the vibrations caused, which is not only extremely unpleasant for the person working practically underneath the tree but can also adversely affect the surrounding carpeting or the like.

The clamping bars of the Christmas-tree stand according to DE-C 517 609 are pressed against the Christmas-tree trunk by the manually operated thumb nuts. From experience it is known that only comparatively small forces can be applied by such thumb nuts so that the retaining forces holding the Christmas-tree can only be correspondingly small and, thus, the overall stability of the Christmas-tree suffers.

From U.S. Pat. No. 2,628,798, a Christmas-tree stand as described in the preamble of claim 1 is known. This known Christmas-tree stand comprises a housing with a receiving opening in which the Christmas-tree trunk has to be fastened. Further, two essentially horizontally arranged clamping bars limiting the receiving opening are provided, which can forcibly engage the Christmas-tree trunk, said clamping bars being rotatably supported so as to allow a swivelling movement with one of their ends at the housing in an essentially horizontal plane and being acted upon by a central clamping device at their respective other free ends in such a way that they move essentially symmetrically. The central clamping device comprises a ring in which the free ends of the clamping bars are held. Via a pedal-operated lever, the ring can be moved along the longitudinal extension of the free ends of the clamping bars, said springily constructed clamping bars more or less strongly embrace and fasten the Christmas-tree trunk during the movement of the ring. The basic principle underlying the subject matter of the generic U.S. Pat. No. 2,628,798 is to loosely erect the tree to be erected in the Christmas-tree stand in such a manner that the tree already stands without further help, however, that it can still be adjusted into an exact vertical position. Only after the exact alignment of the tree is the handle for moving the ring and for finally fastening the tree trunk manipulated.

The disadvantage of this Christmas-tree stand is the fact that due to the springy construction of the clamping bars, said clamping bars cannot fasten the Christmas-tree trunk with sufficiently high retaining forces, since they retain a certain reserve of elasticity even in the fastened state. Thus the position of the erected Christmas-tree is not completely stable, which can be a problem particularly in the case of large trees and/or trees with large branches at the base. In addition, stumps of branches protruding in the area of engagement of the clamping bars or tree trunks with extremely non-circular contours generally make a secure fastening in an exact vertical position at least very difficult.

By contrast, the objective of the present invention is to develop a Christmas-tree stand according to the preamble of claim 1 in such a way that, with said stand, tree trunks having non-circular or irregular contours can securely and quickly be fastened in an essentially vertical position.

The objective is accomplished according to the invention by the characteristics of claim 1.

According to the invention, a Christmas-tree stand is provided with: a housing with a vertical axis; a receiving opening positioned in the housing, which is traversed by the vertical axis and in which the Christmas-tree trunk can be fastened essentially parallel to the vertical axis; and at least two clamping bars limiting the receiving opening and being essentially horizontally arranged, with which the inner width of the receiving opening can be adjusted and which forcibly engage the Christmas-tree trunk, said clamping bars being rotatably supported so as to allow a swivelling movement at one of their ends at the housing in an essentially horizontal plane and at their other free ends being capable of being engaged by the central clamping device in such a way that they move essentially symmetrically with respect to the vertical axis. This Christmas-tree stand is further characterized in that the central clamping device comprises a threaded rod which is held rotatably and, in axial direction, stationary in a housing with two inversely threaded sections, which are in engagement with the correspondingly threaded regions at the free ends of the clamping bars.

The Christmas-tree stand according to the invention is characterised by a plurality of features which by their interaction permit a secure and quick fastening in essentially vertical position of tree trunks which may also have a non-circular or irregular contour. Thus, initially a central clamping device engages the clamping bars in such a way that they move essentially symmetrically with respect to the vertical axis of the housing. In this, the clamping bars are rotatably supported at one of their ends at the housing of the Christmas-tree so as to allow a swivelling movement and the central clamping device engages the other free end of each of the clamping bars. Since, in doing so, the clamping bars symmetrically move towards each other, when they are engaged by the central clamping device, hence no clamping bar is pressed against a fixed or stationary support, and since particularly the clamping bars are rotatably supported so as to allow a swivelling movement at the one end and, at the other end, the clamping device engages them and, thus, said clamping bars close in a scissor-like manner when the clamping device is manipulated, tree trunks having non-circular or irregular contours can also be securely and reliably fastened. Since, further, a central, i.e. single clamping device is provided, the manipulation of said central or single clamping device suffices to fasten the tree trunk. Since no plurality of clamping nuts or the like has to be manipulated, the manipulation of the Christmas-tree stand according to the invention is considerably simplified. In particular with respect to the Christmas-tree stand according to the invention, the central clamping device comprises the threaded rod which is held rotatably and, in axial direction, stationary in the housing, said threaded rod comprising two inversely threaded sections, which are in engagement with the correspondly threaded regions at the free ends of the clamping bars. Hereby very high retaining forces can be applied to the Christmas-tree trunk with little constructional effort, said clamping device, however, having an operability of decidedly easy motion and, thus, the high retaining forces can be produced without the application of high forces. The high applicable retaining forces in addition facilitate the exact vertical erection of the Christmas-tree since, due to the high engagement forces of the clamping bars, trunks with non-circular contours, stumps of branches or the like can be displaced by said bars or squeezed aside, so that the tree trunk is not pushed out of its vertical position during clamping.

Advantageous embodiments of the invention are described in the subclaims.

Preferably, the threaded rod of the central clamping device is or can be caused to rotate from the outside of the Christmas-tree housing. Thus, this creates the possibility of causing the threaded rod to rotate in the most varied ways in order to manipulate the central clamping device. Thus, for example according to claim 3, the threaded rod can be caused to rotate via a correspondingly formed handle. The handle can be a detachable lever with a latch mechanism in the manner of a so-called ratchet, a knurl or star wheel or the like. Alternatively, the threaded rod can be caused to rotate by a motor, in particular by an electric motor. Hereby, the special advantage is that the central clamping device can be manipulated virtually by pushing a button, with the possibility of the operating button being connected with the electric motor via a long cable so that it is not necessary to manipulate within the direct vicinity of the thus developed Christmas-tree stand in order to operate the clamping device.

If, the clamping bars have gripping claws at their sides facing the receiving opening, the Christmas-tree trunk to be fastened is even more fixed in its position since at least some of the gripping claws at the clamping bars penetrate into the material of the Christmas-tree during the manipulation of the clamping device and the fixing of the position of the trunk is hereby improved.

The gripping claws may be preferably formed along a recess shaped essentially like a semicircle or circle segment in each clamping bar. Hereby, it is achieved that the gripping claws do not only engage one point of the circumference of the Christmas-tree trunk, but engage, radially distributed, at least a partial area of the trunk's circumference so that the retaining force of the central clamping device does not only punctually or linearly engage the Christmas-tree trunk but at least in part radially or circumferentially.

At least one of the clamping bars may have the shape of a U lying on its side when seen in cross-section, with the two free ends of the legs of the U pointing in the direction of the receiving opening. Because of this, the profile of every clamping bar becomes self-supporting in a particularly advantageous way and, thus, extremely stable; on the other hand, the Christmas-tree trunk is supported via the two free leg ends of the U at at least two points located at a distance along the longitudinal axis of the trunk, whereby the overall support of the Christmas-tree trunk is improved in the Christmas-tree stand according to the invention. Further in an embodiment of the Christmas-tree stand the retaining forces applied by the central clamping device concentrate on the two free leg ends of the U, respectively, so that in cooperation with the gripping claws the Christmas-tree trunk may be fastened extremely securely and safely.

Alternatively to the embodiment of the Christmas-tree stand having U-shaped clamping bars, at least one of the clamping bars can be formed in such a way, that an essentially full surface engagement of at least a partial area of the axial length of the Christmas-tree trunk is achieved. Since, in this embodiment, support of the Christmas-tree trunk is achieved over a certain axial length, the Christmas-tree is held securely and immovably.

In an advantageous embodiment, at least one clamping bar may be pivoted at the housing by means of connecting plates. In particular when the support apperture penetrating the connecting plates is overdimensioned compared to a stationary support means, a better engagement of the clamping bar or bars with the trunk to be fastened results, since then the clamping bars can make a pitching movement around the longitudinal axis.

A covering can be provided which can be placed on the Christmas-tree housing from above and which thus largely covers the clamping bars and the clamping device. Hereby, the optical appearance of the Christmas-tree stand according to the invention is essentially improved on the one hand and, on the other, the movable parts of the central clamping device are protected from direct contact, so that the dangers of dirt and/or accidents are minimized.

A water tank may be removably arranged in the Christmas-tree housing. A tree fastened in the Christmas-tree stand is protected from drying out too quickly by the water which can be filled into the water tank. The advantages resulting therefrom are, inter alia, a reduced tendency of the tree to shed needles, a reduced fire hazard due to a desiccated tree as well as the optical advantage of having a tree with a longer-lasting fresh and green appearance. If the water tank is removable, it can easily be cleaned and newly filled.

Further details, aspects and advantages of the present invention result from the following description referring to the drawings.

FIG. 2 shows a plan view from above on the Christmas-tree stand according to FIG. 1;

FIG. 3 shows an enlarged view of the threaded rod in the central clamping device of the Christmas-tree stand according to the invention;

FIG. 4 shows an enlarged view of a clamping bar of the Christmas-tree stand according to the invention;

FIG. 5 shows a section along the line V—V in FIG. 4 through the clamping bar depicted there; and FIG. 6 shows a side view of a clamping bar according to an embodiment of the present invention.

Figure 1:
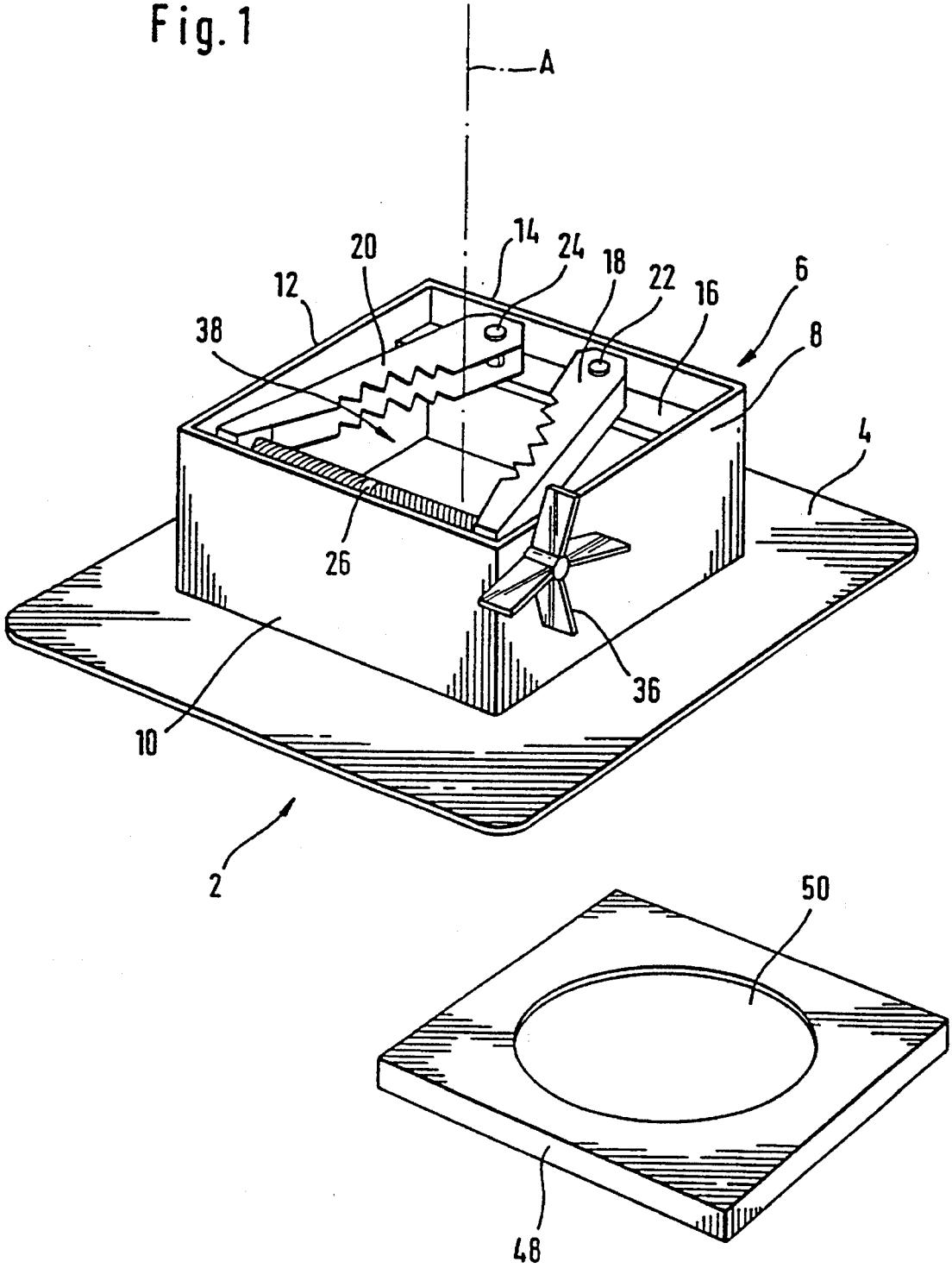
FIG. 1 shows a perspective view of an embodiment of the Christmas-tree stand according to the invention together with the cover appertaining thereto.

FIGS. 1 to 6 of the drawings are not on the same scale, some figures are enlarged in comparison to the remaining ones.

A Christmas-tree stand according to the invention, designated by reference number 2 in all of the drawings, comprises according to FIG. 1 a base plate 4 from which a housing 6 extends upwards. The housing 6 is square or rectangular in the depicted embodiment with side walls 8, 10, 12 and 14 being perpendicular to the base plate. The whole housing 6 is open at the top. The area enclosed by the side walls 8, 10, 12 and 14 is smaller than the area of base plate 4 in order to give secure stability to the Christmas-tree stand with the fastened Christmas-tree.

Between the side walls 8 and 12 at about ⅔ of the height of the sidewalls 8, 10, 12 and 14, a support section 16 extends, which is firmly connected with the housing 6 or the side walls 8 and 12 respectively. In the plate-like support section 16, two clamping bars 18 and 20 are rotatably supported so as to allow a swivelling movement. For this, two support pins 22 and 24 are positioned extending vertically upwards from the support section, which penetrates the corresponding appertures at the free ends of the clamping bars 18 and 20. The position of the clamping bars 18 and 20 on the support pins 22 and 24 is secured for example by retaining rings or pins.

According to FIGS. 1 and 2, the clamping bars 18 and 20 extend from their swivel supports in the area of support section 16 in the direction of the side wall 10. As can be taken especially from FIG. 2, a threaded rod 26 is provided running in parallel to the side wall 10 and penetrating the side walls 8 and 12. The threaded rod 26 is held rotatably but stationary in axial direction in the corresponding apertures in the side walls 8 and 12. As can be taken especially from FIG. 2, the threaded rod 26 penetrates the ends of the clamping bars 18 and 20 facing the two support pins 22 and 24. According to FIG. 4, each clamping bar 18 or 20, respectively, has at this free end a retaining cage 28, in which a screwed nut 30 or 30', respectively, is supported. The screwed nut 30 or 30', respectively, is in engagement with the threaded rod 26.

According to FIG. 3, the threaded rod 26 comprises two threaded sections 32 and 34 separated from each other. The threaded section 32 comprises a thread pitch which is inversed to the threaded sections 34 of the thread formed there. One end of the threaded rod 26 protruding in the area of the side wall 8 is provided with a corresponding handle 36. The handle 36 serves for manually rotating the threaded rod 26 and can be a star wheel in the depicted embodiment. The wings of the star wheel are preferably constructed to such a length that rotation of the star wheel and thus of the threaded rod 26 is possible by hand as well as, if necessary, by the tip of the foot or shoe. As an alternative to the star wheel, the handle 36 can be a knurl wheel, a lever attachable to the free end of the threaded rod—preferably in the form of a so-called ratchet—or the like. Preferably, the respective handle 36 is only attached to the free end of the threaded rod and can be detached if need be, so that the threaded rod 26 can no longer be rotated. A detachable handle 36 thus represents an effective protection for children.

Alternatively to rotating the threaded rod 26 by means of a correspondingly constructed handle 36, the end of the threaded rod 26 protruding in the area of side wall 8 can be actuated by means of an electric motor capable of reversing operation—if need be, through the insertion of a reduction gear. From this the special advantage results that the threaded rod 26 is operable virtually by pushing a button; said operating button can be connected to the electric motor via a long cable so that for turning the threaded rod 26, it is not necessary to manipulate in the immediate vicinity of the Christmas-tree stand thus constructed.

As can be taken particularly from FIG. 2, the erection of the Christmas-tree stand 2 according to the invention is essentially symmetrical to a vertical axis A of the housing 2. The vertical axis A lies essentially parallel to the trunk of a Christmas-tree fastened in the Christmas-tree stand according to the invention. In the embodiment depicted in FIGS. 1 and 2, the base plate 4 and the side walls 8, 10, 12 and 14 are arranged symmetrically to the vertical axis. Between the two clamping bars 18 and 20 the receiving opening 38 is defined which serves for receiving the end of a Christmas-tree trunk to be fastened, which is not shown in the drawing. For fastening or retaining the Christmas-tree trunk, each of the clamping bars 18 and 20 according to FIG. 4 includes a recess 40 shaped essentially like a semicircle or circle segment, with the clamping bars 18 and 20 being preferably designed with teeth in the area of the recess 40 and, thus, provided with gripping claws or teeth 42. Together with the recess 40 shaped like a circle segment or semicircle, the gripping claws 42 cause a particularly secure positioning of the trunk to be fastened, as will be elucidated in the following.

As can further be taken from FIG. 5, each of the clamping bars 18 and 20 has a cross section in the shape of a U lying on its side, whereby the free ends of the legs 44 and 46 of the U face the receiving opening 38. The distance D between the two legs 44 and 46 of the U is preferably chosen to have such a length, that the trunk to be fastened receives a relatively long axial fastening and is, thus, securely and tightly fastened in the Christmas-tree stand.

For fastening or clamping, respectively, the free end of the Christmas-tree trunk in the Christmas-tree trunk stand 2 according to the invention, the free trunk end is placed in the receiving opening 38 in such a way that the longitudinal middle axis of the trunk approximately coincides with the vertical axis A. Here, the two clamping bars 18 and 20 are in the position represented by a full line in FIG. 2, in which the space formed between the recesses 40 and representing the receiving opening 38, is opened to a maximum and, therefore, the receiving opening 38 is extended to a maximum. Subsequently, the threaded rod 26 is caused to rotate by means of the handle 36 or via the electric motor. Due to the nuts 30 or 30', respectively, running on the inversely threaded sections 32 and 34, the two free ends of the clamping bars 18 and 20 are symmetrically moved towards each other, i.e. clamping bar 18 rotates in FIG. 2 clockwise around support pin 22 and clamping bar 20 rotates in FIG. 2 counter-clockwise around support pin 24. Through this scissor-like movement of the two clamping bars 18 and 20, directed towards each other, with the movements of the clamping bars 18 and 20 being symmetrical to the vertical axis A, the receiving opening 38 is reduced. In the way of the movement of clamping bars 18 and 20, directed towards each other, clamping bars 18 and 20 finally engage, in the area of their recesses 40, portions of the circumference of the tree trunk to be fastened. Further rotation of the threaded rod 26 now results in the fact that gripping claws 42 in the recesses 40 of the clamping bars 18 and 20 penetrate into the material of the tree trunk and, thus, fasten the Christmas-tree and fix its vertical position. Since, according to FIG. 5, each clamping bar has the form of a U lying on its side, with the free leg 44 as well as the free leg 46 each comprising a recess 40 with the gripping claws constructed therein, support of the tree trunk in vertical direction is achieved by the free leg 44 on the one hand and, on the other hand, by the free leg 46 being positioned below at a vertical distance D. Through this, a fastening of the tree trunk in two planes takes place, namely once in the plane of the free legs 44 facing each other of the clamping bars 18 and 20, and further in the plane of the free legs 46 facing each other of the clamping bars 18 and 20. By this fastening in two planes which are axially separated from each other by the distance D, a fastening secure against tilting of the Christmas-tree trunk is achieved without having to fix the lower face of the trunk by a centering spike.

The threaded pitch of the threaded sections 32 and 34 on the threaded rod 26, as well as the thread pitch of nuts 30 and 30' is selected in such a way that automatic locking occurs and after releasing the handle 36 or after switching off the electric motor for rotating the threaded rod 26, clamping bars 18 and 20 remain in their positions and fasten the Christmas-tree trunk.

In FIG. 2, the position of closest proximity of the two clamping bars 18 and 20 is indicated by the phantom line, whereby the space defined between clamping bars 18 and 20 or between the recesses 40 located there is decreased to a minimum in this position of closest proximity, that is the receiving opening 38 is decreased to a minimum. Since, as can directly be taken from FIG. 2, each of the clamping bars 18 and 20 forms a different angle with the threaded rod 26 in the maximally opened position than in the maximally closed position (drawing in full line and drawing in phantom line), nuts 30 and 30', respectively, are taken up in retaining cages 28 of clamping bars 18 and 20 in such a way that they are prevented from falling out of the retaining cage 28 as well as from turning inside the retaining cage, however, they can execute pitching movements with respect to the retaining cage 28 and thus with respect to clamping bars 18 and 20, respectively, in order to allow the different angle positions of clamping bars 18 and 20, respectively, with respect to the threaded rod 26. For facilitating these pitching movements of nuts 30 and 30', respectively, in their retaining cages 28, the nuts 30 and 30' are preferably not plane at the surfaces facing each other, which are centrally penetrated by the bore with the nut internal thread, but are slightly protruding or spherical. Due to this spherical structure of the two surfaces, the nuts 30 and 30' can more easily roll off at the corresponding opposite surfaces of the retaining cages 28 within the swivel angle of the clamping bars 18 and 20 with respect to threaded rod 26, so that the necessary pitching movements of nuts 30 and 30' are facilitated.

For releasing clamping bars 18 and 20 from the Christmas-tree trunk in order to remove the same from the Christmas-tree stand 2, threaded rod 26 is turned in the opposite direction by handle 36 or the electric motor so that clamping bars 18 and 20 pivot in the opposite direction and open scissor-like, whereby the retaining claws 42 of clamping bars 18 and 20 are detached from the circumference of the tree trunk and finally the tree trunk can be removed from the Christmas-tree stand by the enlarging receiving opening 38.

According to FIG. 1, a cover 48 is preferably provided whereby clamping bars 18 and 20 and threaded rod 26 can be completely covered to a very large extent. Hereby a protection is provided against unintended touch of the threaded sections 32 and 34, which are for example suitably greased, as well as a protection of the whole clamping device against dirt or the like. In cover 48 an opening 50 is centrally provided, which is preferably traversed centrally by the vertical axis A, so that the Christmas-tree to be fastened can be introduced into the receiving opening 38 through opening 50.

In the interior of the housing 6, a plastic container is preferably provided, which can, if need be, be removed from the housing and which can be filled with water in order to prevent the fastened Christmas-tree from drying out too quickly.

Within the framework of the present invention, a plurality of modifications and alterations is conceivable. Some of these alterations will be considered in the following.

Thus, for example, the cross-section of the clamping bars 18 and 20 is not limited to the depicted U-form; clamping bars 18 and 20 can, if need be, also have a cross-section of a hollow square so that instead of the free ends of the legs 44 and 46, each clamping bar 18 and 20 can fully engage at least a partial area of the axial length of the Christmas-tree trunk. Further, each clamping bar 18 and 20 can comprise a solid square cross-section so that each clamping bar 18 and 20 is provided as a solid rod. In this respect, recess 40 with the appertaining retaining claws 42 can again be constructed in each of the clamping bars 18 and 20.

In an embodiment of the present invention, clamping bars 18 and 20 are constructed according to FIG. 6. FIG. 6 depicts a side view on clamping bar 18. Clamping bar 20 is formed correspondingly symmetrically. Instead of the bore depicted in FIG. 4 for receiving the support pin 22, with the bore penetrating the free leg 44 as well as the free leg 46, a connecting plate 52 is provided with the clamping bar according to FIG. 6 at the end of the clamping bar, which has to be pivoted at the support pin 22. The connecting plate 52 can either be welded to the corresponding end of clamping bar 18 or be fastened otherwise, or it can be integral with the clamping bar ends as a one-piece construction. Connecting plate 52 comprises a bore, illustrated by the phantom line 54, for receiving the support pin 22 in order to rotatably support the clamping bar 18. As already mentioned, clamping bar 20 is constructed to be correspondingly symmetrical.

The bore 54 preferably comprises a somewhat larger inner diameter than the outside diameter of the support pin 22, so that clamping bar 18 is guided with clearance at the support pin 22. Hereby, clamping bar 18 (and, analogously, clamping bar 20 in a corresponding construction) is enabled to make a pitching movement around its longitudinal axis. Hereby, an even improved contact of clamping bars 18 and 20 with the outer contour of the trunk to be fastened is achieved in particular when there are irregularities of the outer trunk contour in the area of clamping, like, for example, stumps or branches or the like.

In addition to the two support pins 22 and 24, two or, if need be, four additional support pins, not included in the drawing, can be provided in the area of support section 16, so that the position of clamping bars 18 and 20 may be changed from one to another of the further or closer distanced support pins. Hereby, the Christmas-tree stand 2 can quickly and without problems be adapted to all kinds of trunk diameters.

We claim:

1. Tree stand comprising:

a housing having a vertical axis;

a receiving opening positioned in said housing which is traversed by said vertical axis and in which a tree trunk may be vertically received such that said tree trunk is disposed within said housing substantially parallel to said vertical axis;

at least two substantially horizontally arranged clamping bars defining said receiving opening, said clamping bars including a free end and a supported end and being supported at said supported ends so as to allow said clamping bars to swivel in a substantially horizontal plane at said supported ends, said receiving opening being adjustable by said clamping bars whereby said clamping bars may be engaged with said tree trunk, wherein each of said free ends of said clamping bars includes a threaded region; and a central clamping device including two inversely threaded sections which engage said threaded regions of said free ends of said clamping bars, said central clamping device comprising a threaded rod which is rotatable with respect to said housing, wherein said clamping bars are adapted to move simultaneously and substantially symmetrically with respect to said vertical axis responsive to rotation of said threaded rod.

2. Tree stand according to claim 1, wherein said threaded rod can be caused to turn from outside of said housing.

3. Tree stand according to claim 2, further comprising:

a handle connected to said threaded rod for rotating said threaded rod.

4. Tree stand according to claim 1, wherein said clamping bars include gripping claws facing said receiving opening.

5. Tree stand according to claim 4, wherein said gripping claws form semi-circular recesses within said clamping bars.

6. Tree stand according to claim 1, wherein at least one of said clamping bars has a cross-section in the shape of a U lying on its side including two legs extending towards said receiving opening.

7. Tree stand according to claim 1, wherein at least one of said clamping bars includes a substantially full engagement area for engaging at least a partial area of the axial length of said tree trunk.

8. Tree stand according to claim 1, further comprising a connecting plate including a boring disposed adjacent said support end of at least one of said clamping bars, whereby at least one of said clamping bars may be caused to pivot with respect to said housing.

9. Tree stand according to claim 1, further comprising a cover which completely covers said clamping bars and said clamping device, and can be placed on said housing from above.

10. The tree stand of claim 1, wherein said threaded regions comprise non-rotatable nuts disposed within said free ends of said clamping bars.

11. Tree stand according to claim 1, wherein said clamping bars may be pitched about their longitudinal axes to fasten a tree trunk having an irregular outer surface.

* * * * *